US011335518B2

(12) United States Patent
Poczontek et al.

(10) Patent No.: US 11,335,518 B2
(45) Date of Patent: May 17, 2022

(54) SWITCHING ELEMENT GUIDE

(71) Applicant: Rockwell Automation Switzerland GmbH, Aarau (CH)

(72) Inventors: Dariusz Poczontek, Aarau (CH); Rahel Von Arx, Aarau (CH); Marcin Morys, Aarau (CH); Beat Schreiber, Aarau (CH)

(73) Assignee: Rockwell Automation Switzerland GMBH

( * ) Notice: Subject to any disclaimer, the term of this patent is extended or adjusted under 35 U.S.C. 154(b) by 0 days.

(21) Appl. No.: 17/014,784

(22) Filed: Sep. 8, 2020

(65) Prior Publication Data

US 2022/0076900 A1 Mar. 10, 2022

(51) Int. Cl.
*H01H 3/38* (2006.01)
*H01H 9/02* (2006.01)

(52) U.S. Cl.
CPC ..... *H01H 3/38* (2013.01); *H01H 9/02* (2013.01); *H01H 2221/024* (2013.01)

(58) Field of Classification Search
CPC ..... H01H 1/20; H01H 15/02; H01H 3/38; H01H 9/02; H01H 2221/024
USPC ..... 200/243, 293, 50.02, 502, 329
See application file for complete search history.

(56) References Cited

U.S. PATENT DOCUMENTS

| | | | | |
|---|---|---|---|---|
| 2,840,657 | A | 6/1958 | Roeser | |
| 2,985,736 | A | 5/1961 | Coker et al. | |
| 5,075,517 | A | 12/1991 | Spanio | |
| 6,013,889 | A | 1/2000 | Wieloch | |
| 6,198,058 | B1 | 3/2001 | Graninger et al. | |
| 6,556,110 | B1 | 4/2003 | Niebler et al. | |
| 6,880,226 | B2 * | 4/2005 | McGill | H01H 50/546 200/16 A |
| 9,312,084 | B2 | 4/2016 | Rosch et al. | |
| 9,613,761 | B2 * | 4/2017 | Bruchschmidt | H01H 13/503 |

(Continued)

FOREIGN PATENT DOCUMENTS

| | | | |
|---|---|---|---|
| DE | 102014114497 | A1 | 6/2016 |
| FR | 2614728 | A1 | 11/1988 |
| SE | 462409 | B | 6/1990 |

OTHER PUBLICATIONS

Extended European Search Report dated Feb. 9, 2022; Application No. 21190551.8-1206/3965129—(11) pages.

*Primary Examiner* — Edwin A. Leon
*Assistant Examiner* — Iman Malakooti
(74) *Attorney, Agent, or Firm* — Boyle Fredrickson, SC

(57) ABSTRACT

An improved switching device includes a guide configured to reduce undesired movement of the switching element. The guide includes an upper portion configured to receive the switching element and a lower portion configured to receive a spring. The upper portion defines a seat to receive the switching element and includes at least one resilient tab to retain the switching element within the guide. The lower portion defines an opening in which the spring is positioned, where the spring is seated, in part, against the switching element and against the guide. The guide includes guide portions configured to engage a housing on the switching device to prevent rotation of the switching element within the switching device. The switching element further includes protrusions configured to engage each side of the guide and to prevent longitudinal movement of the switching element within the housing.

20 Claims, 6 Drawing Sheets

(56) References Cited

U.S. PATENT DOCUMENTS

| | | | | |
|---|---|---|---|---|
| 10,049,827 | B2 * | 8/2018 | Thar | H01H 1/30 |
| 2014/0224629 | A1 | 8/2014 | Rosch et al. | |

* cited by examiner

SWITCHING ELEMENT GUIDE

BACKGROUND INFORMATION

The subject matter disclosed herein relates to a switching device including a mechanical switching element which physically moves within a chamber between a closed and an open position. More specifically, a guide for the switching element is disclosed, which acts to retain the switching element in a desired physical orientation within the chamber.

As is known to those skilled in the art, switching devices are components in an electrical circuit that may be controlled between an "ON" and an "OFF" state. In the ON state, the switching device establishes an electrical connection between contacts and allows electrical current to flow through the switching device from a power source to an electrical load. In the OFF state, the switching device breaks the electrical connection between contacts, preventing the electrical current from flowing through the switching device. Switching devices may be used, for example, as a circuit breaker, motor protection device, contactor to supply power to one or more branch circuits, or the like. The switching device may be manually or automatically actuated. A mechanical switch or electronic actuator is provided which moves between two states. In one state, the mechanical switch or electronic actuator causes the switching device to establish the electrical connection, and, in the other state, the mechanical switch or electronic actuator causes the switching device to break the electrical connection.

Typically, the mechanical switch or electronic actuator will cause a plunger to move a switching element within the switching device in a first direction as the switch or actuator transition from a first state to a second state. When the mechanical switch or electrical actuator, transition back from the second state to the first state, a spring causes the switching element to return to its original position. The switching element moves within a channel defined within the switching device.

However, these switching devices are not without certain challenges. During normal operation, the potential exists for the switching element to "bounce". As the spring returns the switching element to its original position, the force of the switching element impacting the other contact to close the circuit may cause a small amount of recoil. In particular, after many cycles and as the spring wears, the force applied by the spring may weaken, such that the spring does not immediately hold the switching element against the contact when closing the circuit. During this recoil, the switching element is no longer mechanically held between the plunger and the spring in its desired orientation within the channel. The switching element may move side-to-side, front-to-back, or even rotate within the channel. Movement of the switching element may, at a minimum, reduce the surface area of contacts that establish a physical connection, accelerating wear between contacts, or, in a worst case, cause failure of the switching device.

Potential movement of the switching element within the switching device is not limited to normal wear of the switching device. During commissioning, for example, a control circuit that is not yet operating correctly may cause a rapid cycling of state in the switching device between the ON and OFF states. This rapid cycling may simulate a bounce condition, where the plunger and spring are not always holding the switching element in place and the switching element may move or rotate within the channel. Similarly, a sharp force applied to the housing of the switching element, for example, during transport, may cause a vibration or impulse force to the device during which the spring compresses enough for the switching element to move or rotate within the channel. Such a force received by the switching device during shipping may result in premature failure of the device.

Thus, it would be desirable to provide an improved switching device in which undesired movement of the switching element is reduced.

It would also be desirable to provide a guide for the switching element which positively retains the switching element in a desired orientation within the switching device.

BRIEF DESCRIPTION

According to one embodiment of the invention, a guide for a switching element includes a front member, a rear member, a first side member, and a second side member. The front member is configured to extend longitudinally along a front side of the switching element, and the rear member is configured to extend longitudinally along a rear side of the switching element. The front member includes a first seat configured to receive a lower surface of the switching element and a first tab configured to retain the switching element within the guide. The rear member includes a second seat configured to receive the lower surface of the switching element and a second tab configured to retain the switching element within the guide. The first side member has a front edge and a rear edge, where the first side member extends between a first end of a lower portion of the front member and a first end of a lower portion of the rear member. The second side member has a front edge and a rear edge, where the second side member extends between a second end of the lower portion of the front member and a second end of the lower portion of the rear member. The first side member includes a first guide portion protruding outward from the front edge of the first side member and a second guide portion protruding outward from the rear edge of the first side member. The second side member incudes a third guide portion protruding outward from the front edge of the second side member, and a fourth guide portion protruding outward from the rear edge of the second side member. An opening is defined between the first side member and the second side member, where the opening is configured to receive a spring between the first and second side members. The spring engages the lower surface of the switching element, the lower portion of the front member, and the lower portion of the rear member when it is inserted into the opening.

According to another embodiment of the invention, a switching device includes a plunger, a spring, a switching element, and a guide for the switching element. The plunger is configured to move reciprocally along an axis between a first position and a second position, and the spring is configured to be selectively compressed as the plunger is moved reciprocally along the axis. The switching element is positioned between the plunger and the spring. The spring is seated, at least in part, against the switching element, and the switching element receives a force applied by the spring in a direction toward the plunger. The guide includes an upper portion defining a seat for the switching element, at least one tab located on the upper portion, and a lower portion defining an opening in which an end of the spring is seated. The at least one tab is configured to retain the switching element within the guide, and the end of the spring is seated in part against the switching element and in part against the guide.

According to still another embodiment of the invention, a guide for a switching element includes an upper portion, a lower portion, and at least one tab located on the upper portion. The upper portion defines a seat for the switching element, and the at least one tab is configured to retain the switching element within the guide. The lower portion defines an opening in which an end of a spring is seated, where the end of the spring is seated in part against the switching element and in part against the guide.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Various exemplary embodiments of the subject matter disclosed herein are illustrated in the accompanying drawings in which like reference numerals represent like parts throughout, and in which.

Figure 1:
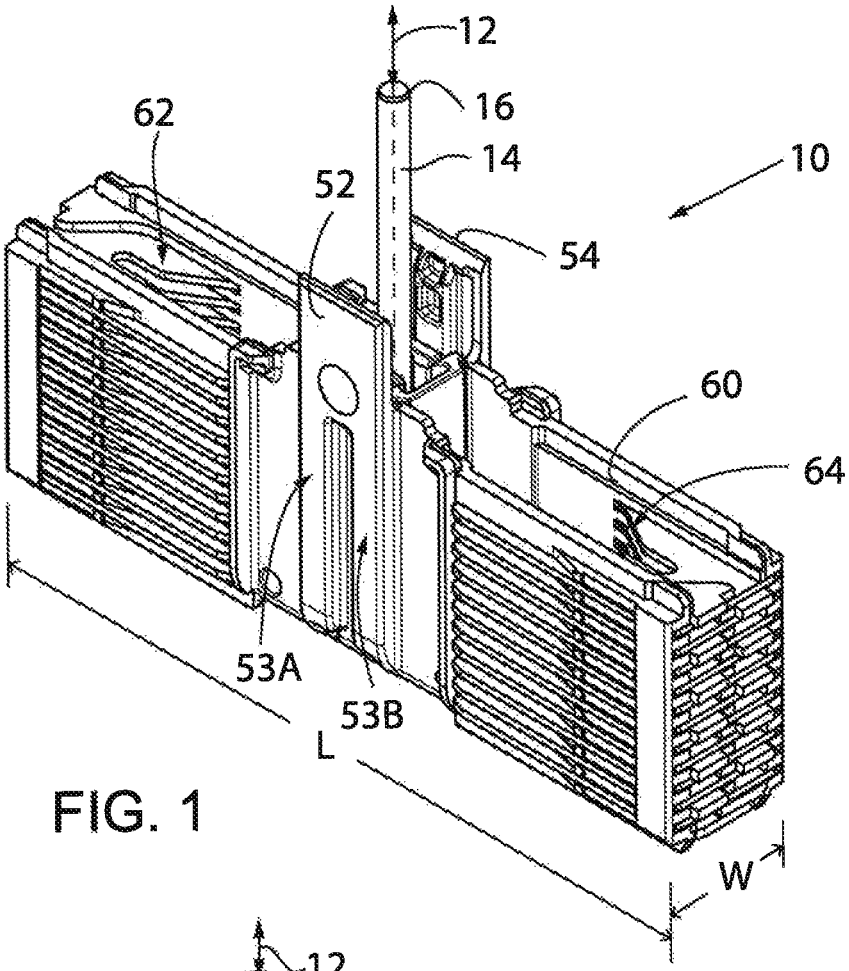
FIG. 1 is a partial perspective view of a switching device incorporating a switching element guide according to one embodiment of the invention.

In describing the various embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION

The various features and advantageous details of the subject matter disclosed herein are explained more fully with reference to the non-limiting embodiments described in detail in the following description.

The subject matter disclosed herein describes an improved switching device in which undesired movement of the switching element is reduced. The switching device may be, for example, a circuit breaker, a motor protection circuit, an electrical contactor, or the like. The switching device includes a manual or automatic actuator that causes a plunger to move reciprocally along an axis between a first position and a second position, where the first and second positions define an "On" and an "Off" position for the switching device. The switching device also includes a spring to be selectively compressed as the plunger moves reciprocally along the axis. A switching element is positioned between the plunger and the spring, where the spring is seated, at least in part, against the switching element. The spring is at least partially compressed in both the first and the second positions and applies a force against the switching element in the direction of the plunger.

A guide is provided for the switching element which positively retains the switching element in a desired orientation within the switching device. According to one embodiment of the invention, the guide includes an upper portion configured to receive the switching element and a lower portion configured to receive the spring. The upper portion includes a front member and a rear member, where the front and rear members each include a portion of a seat to receive the switching element. The front and rear members each include a resilient tab, where the resilient tab is configured to deflect outward as the switching element is inserted between the tabs on the front and rear members and to return to their original locations when the switching element is located in the seat of the guide to retain the switching element within the guide. The lower portion includes a first side member and a second side member. The first side member extends between a first side of a lower portion of the front and rear members, and the second side member extends between a second side of the lower portion of the front and rear members. According to one aspect of the invention, the front member, rear member, first side member, and second side member are each made from a plastic material and integrally formed as a single mechanical element The guide includes guide portions configured to engage a housing on the switching device to prevent rotation of the switching element within the switching device. Guide portions protrude outward from front edges of the first and second side members to engage complementary channels extending along a first side of a housing for the switching device. Guide portions also protrude outward from rear edges of the first and second side members to engage complementary channels extending along a second side of a housing for the switching device. As the switching element moves between the first and second positions, the guide portions slide within the channels of the housing. If the spring were to temporarily disengage the switching element due, for example, to vibration or a spring bounce, the guide portions prevent rotation of the switching element within the housing.

The switching element further includes protrusions configured to engage the guide and to prevent longitudinal movement of the switching element within the housing. A pair of protrusions extend from each side of the switching element and are spaced apart a distance generally equal to the width of the guide. When the guide is mounted on the switching element, the guide is positioned between the protrusions on each side of the switching element. If the spring were to temporarily disengage from the switching element, the protrusions engaging the guide, prevent the switching element from moving in the longitudinal direction of the switching element. It is also contemplated that the channels in the side of the housing may have a width generally equal to the width of the guide portions, such that the guide portions may also restrict movement in the longitudinal direction in addition to preventing rotation of the switching element.

Figure 2:
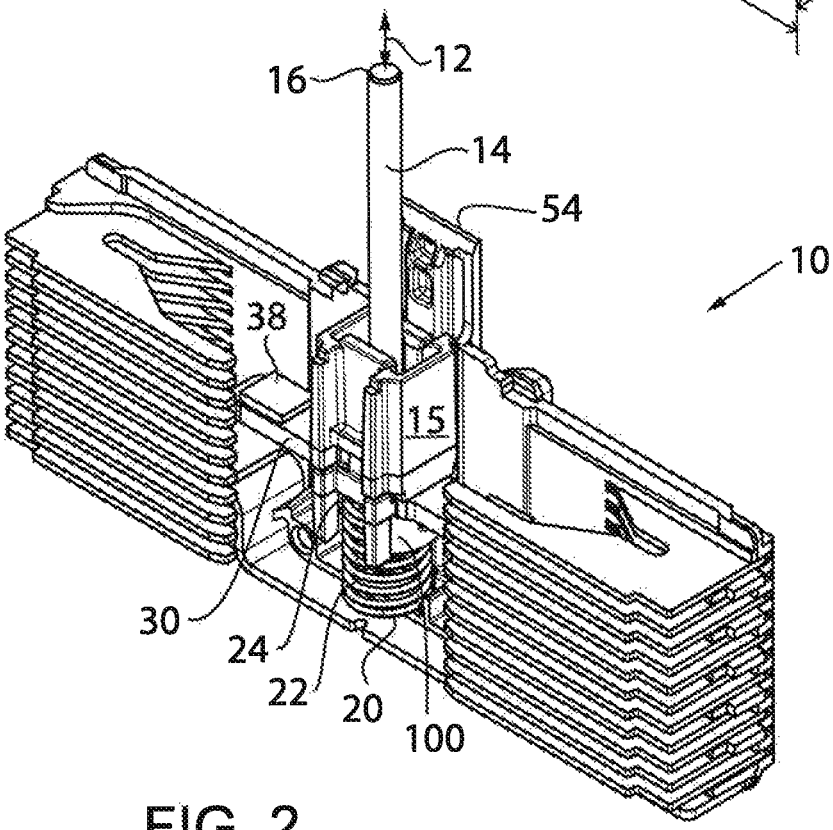
FIG. 2 is a partial perspective view of the switching device of FIG. 1 with one wall of a housing for the switching element removed.

Turning initially to FIGS. 1-2, a switching device 10 that may be incorporated into an electrical switch, such as a circuit breaker, a motor protection circuit, an electrical contactor, or the like is illustrated. The switching device 10 includes a plunger 14 configured to move reciprocally, back-and-forth, along an axis 12. A first end 16 of the plunger 14 is configured to engage an actuator in the electrical switch. The actuator may be manually activated by, for example, a toggle switch or a rotary switch. Optionally, the actuator may be automatically activated, for example, by a solenoid energized by a relay. Regardless of manual or automatic actuation, the plunger 14 is configured to move between a first position and a second position. The second end 18 of the plunger 14 (see e.g., FIG. 6) is configured to be inserted into a plunger seat 15. The plunger seat 15 may have a lower surface against which the second end 18 of the plunger 14 rests. Optionally, the plunger seat 15 may have an open end and the plunger seat 15 is configured to align the plunger with the switching element 30. The second end 18 of the plunger 14 may then rest against the switching element 30. The plunger 14 applies a force to the switching element 30 when the actuator drives the plunger from the first position to the second position either directly if the second end 18 rests on the switching element 30 or indirectly via the plunger seat 15 if the plunger seat 15 includes a lower surface.

Terms such as upper, lower, inner, outer, front, rear, left, right, and the like will be used herein with respect to the illustrated switching device 10. These terms are relational with respect to the illustrated switching device and are not intended to be limiting. It is understood that the switching device may be installed in different orientations, such as vertical or horizontal, or may be rotated one hundred eighty degrees without deviating from the scope of the invention.

Figure 3:
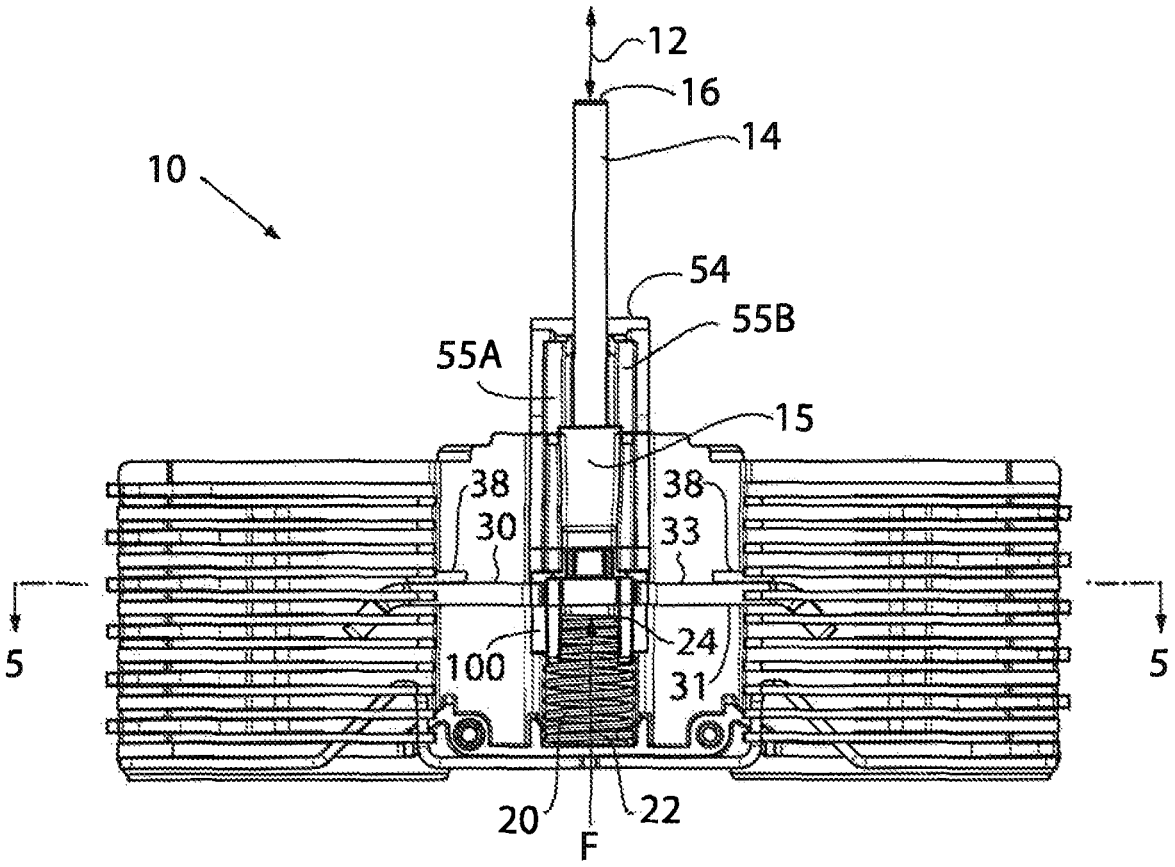
FIG. 3 is a front elevation view of the switching device of FIG. 2.
Figure 4:
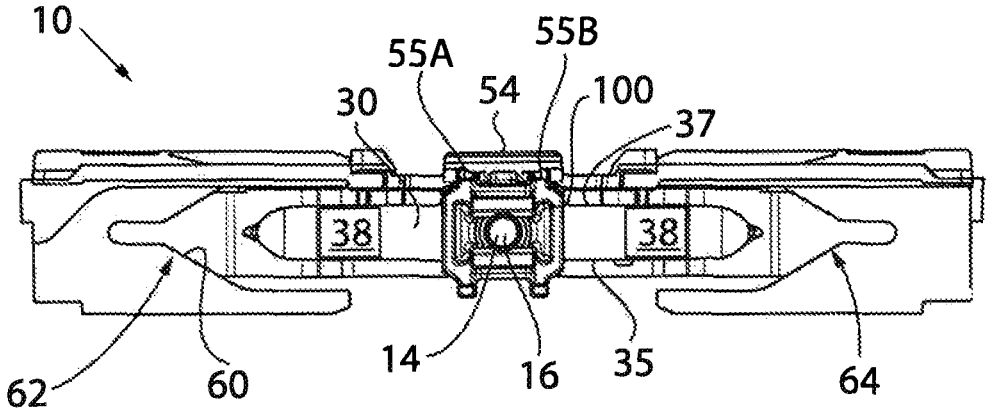
FIG. 4 is a top plan view of the switching device of FIG. 2.

With reference also to FIG. 3, the switching device 10 includes a spring 20 which applies a force, F, in a direction opposing actuation of the plunger 14. The spring 20 has a first end 22 which is seated against a lower housing of the switching device 10 and a second end 24 which is seated, at least in part, against a lower surface 31 of the switching element 30. When the plunger 14 is in the first position, the spring 20 may be partially compressed such that it applies a sufficient force against the switching element 30 to stay in the first position. As the actuator drives the plunger 14 from the first position to the second position, the spring becomes more compressed, applying a greater force against the switching element 30. When the actuator releases the plunger 14, the spring 20 causes the switching element 30 to return to and stay in the first position.

The switching element 30 is an assembly that includes at least one contact 38 mounted on the switching element 30. The contact 38 is configured to engage a complementary contact in the first position and to disengage from the complementary contact as the switching element 30 is moved from the first position to the second position. According to the illustrated embodiment, the switching element 30 includes a pair of contacts 38 where one contact is mounted to the switching element on one side of the plunger 14 when the plunger engages the switching element and the other contact is mounted on the other side of the plunger 14. It is contemplated that other arrangements of contacts 38 may be mounted to the switching element without deviating from the scope of the invention.

Figure 5:
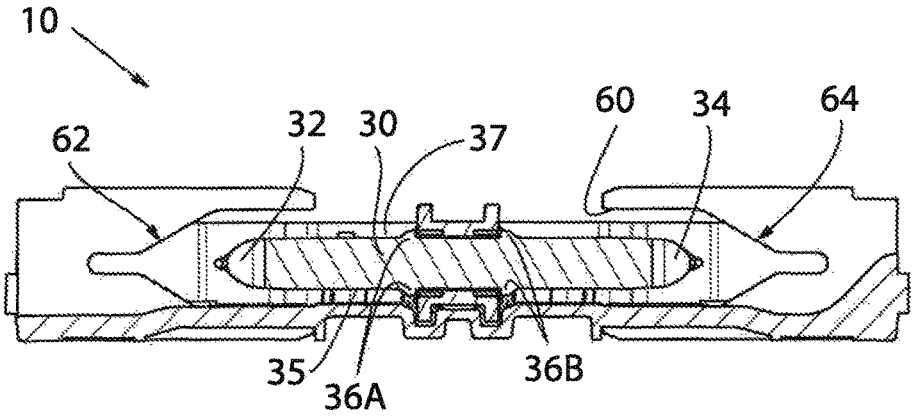
FIG. 5 is a sectional view of the switching device taken at 5-5 as shown in FIG. 3.
Figure 6:
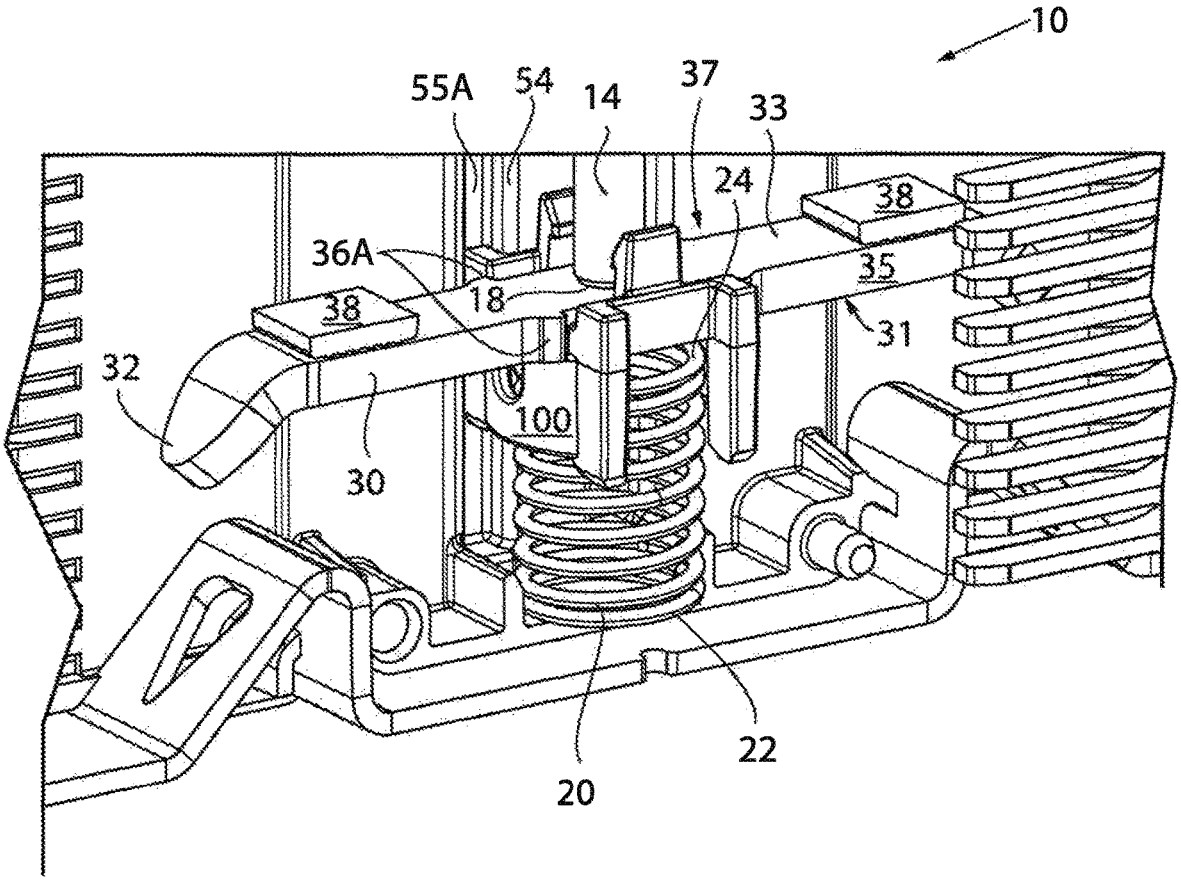
FIG. 6 is a partial perspective view of the switching device of FIG. 2 with a portion of the channel for the switching element removed.
Figure 7:
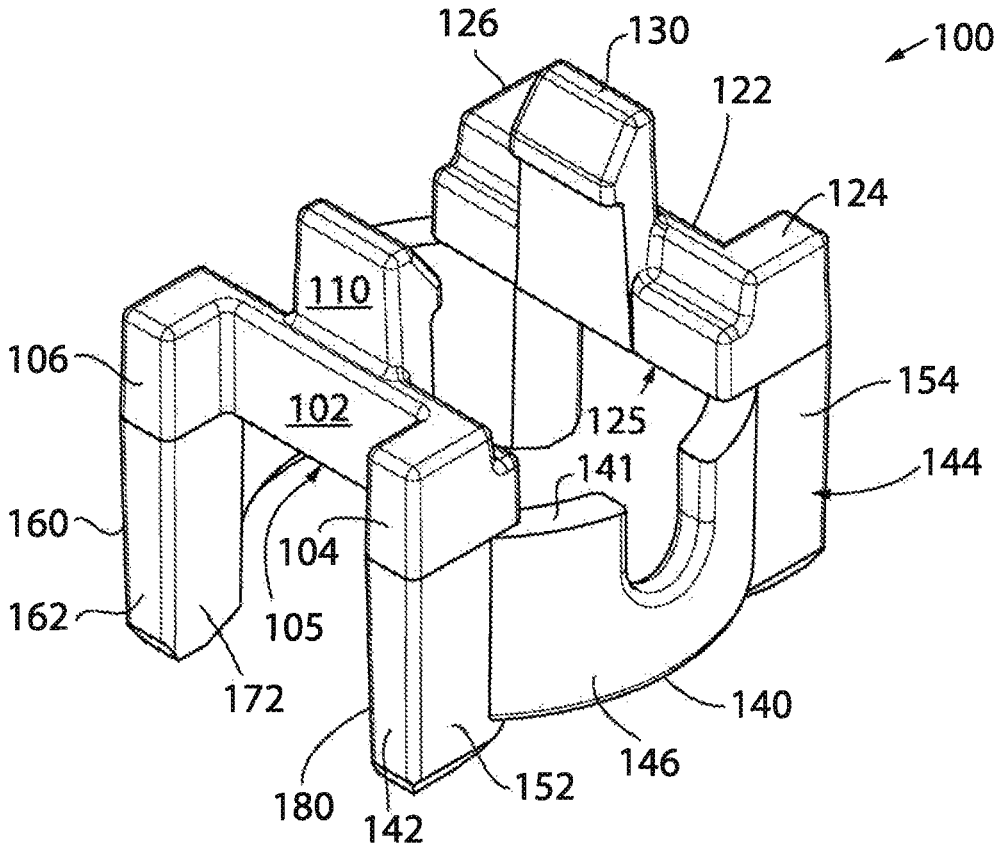
FIG. 7 is a perspective view of the switching element guide of FIG. 1.
Figure 8:
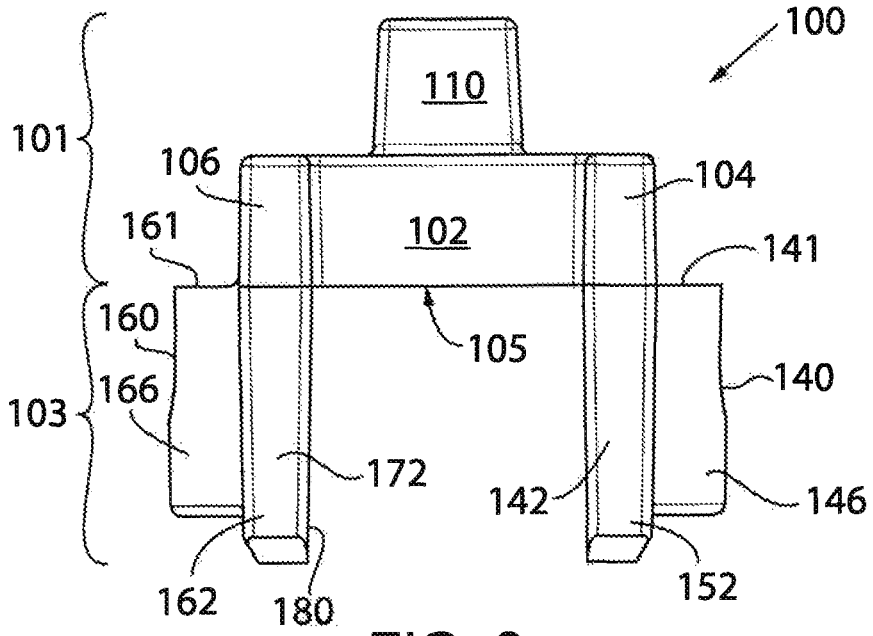
FIG. 8 is a front elevation view of the switching element guide of FIG. 1.
Figure 9:
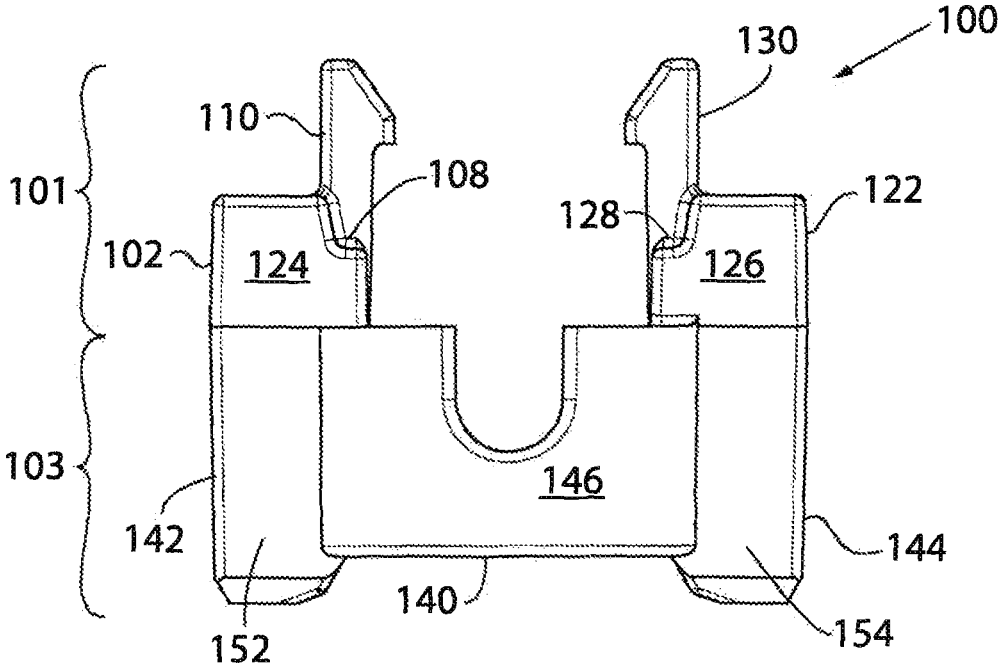
FIG. 9 is a side elevation view of the switching element guide of FIG. 1.
Figure 10:
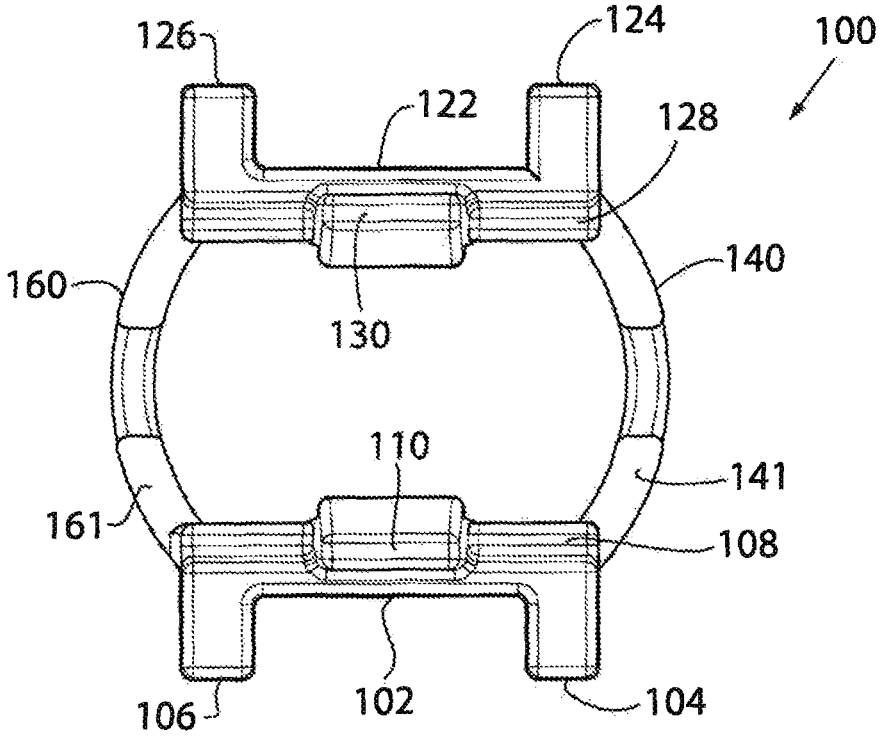
FIG. 10 is a top plan view of the switching element guide of FIG. 1.
Figure 11:
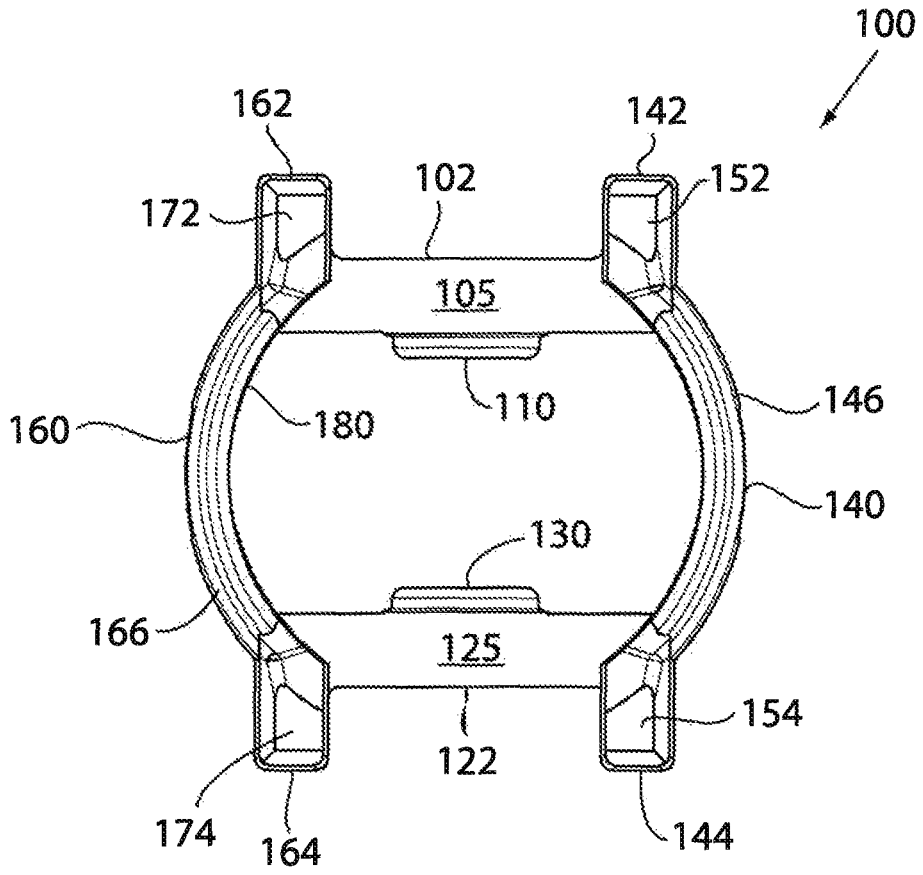
FIG. 11 is a bottom plan view of the switching element guide of FIG. 1.

With reference again to FIG. 1 and to FIGS. 5-6, the illustrated switching device 10 has a longitudinal form, where a length, L, of the switching element 30 is greater than a width, W, of the switching device. The switching device 10 includes a housing 50, where the housing has a first side 52 and a second side 54, the second side opposite the first side. A switching element channel 60 is defined, at least in part, by the housing 50 of the switching device 10. The switching element channel 60 has a first end 62 proximate one end of the switching device 10 and a second end 64 proximate another end of the switching device 10. The switching element channel 60 has a sectional area greater than the switching element 30 such that the switching element is free to move within the switching element channel. A first end 32 of the switching element 30 is located in the first end 62 of the switching element channel 60, and a second end 34 of the switching element 30 is located in the second end 64 of the switching element channel 60.

A switching element guide 100 mounts on the switching element 30 and is configured to align the switching element 30 and to prevent undesired movement of the switching element within the switching element channel 60. The switching element guide 100 includes at least one guide portion protruding from the guide, the guide portion configured to engage a channel 55 in the housing 50 of the switching element. According to the illustrated embodiment, the front and rear of the switching element guide 100 each include a pair of guide portions. The first side 52 of the housing includes a pair of channels 55 extending along an interior surface of the housing, and the second side 54 of the housing similarly includes a pair of channels 55 extending along an interior surface. As the switching element 30 moves between the first and second positions, the guide portions slidably engage the channels 55 in the housing 50.

Turning next to FIGS. 7-11, one embodiment of the switching element guide 100 is illustrated. The illustrated switching element guide 100 will be described with respect to an upper portion 101 and a lower portion 103. It is contemplated that the two portions may both be made from a plastic material and integrally formed as a single element. Optionally, portions of the guide 100 may be made from separate portions and joined by any suitable method, such as by a fastener, an adhesive, thermal welding, ultrasonic welding, and the like.

The upper portion 101 of the illustrated switching element guide 100 includes a front member 102 and a rear member 122. The front member 102 is configured to extend longitudinally along a front side 35 of the switching element 30 when the guide 100 is mounted to the switching element. The front member 102 extends between a first end 104 and a second end 106 and includes a seat 108 extending along an inner surface of the front member. The seat 108 is configured to receive a lower surface 31 of the switching element 30 when the guide 100 is fit onto the switching element 30. A tab 110 extends upward from the front member 102 and is configured to retain the switching element 30 within the guide 100 when the guide is fit onto the switching element. Similarly, the rear member 122 is configured to extend longitudinally along a rear side 37 of the switching element 30 when the guide 100 is mounted to the switching element. The rear member 122 extends between a first end 124 and a second end 126 and includes a seat 128 extending along an inner surface of the rear member. The seat 128 is configured to receive a lower surface 31 of the switching element 30 when the guide 100 is fit onto the switching element 30. A tab 130 extends upward from the rear member 122 and is configured to retain the switching element 30 within the guide 100 when the guide is fit onto the switching element.

The lower portion 103 of the illustrated switching element guide 100 includes a first side member 140 and a second side member 160. The first side member 140 includes a front edge 142 and a rear edge 144. An upper edge 141 of the first side member 140 extends between the front edge 142 and the rear edge 144. The upper edge 141 of the first side member 140 engages a lower portion 105 of a first end 104 of the front member 102 and a lower portion 125 of a first end 124 of the rear member 122. The first side member 140 includes a first guide portion 152 protruding from the front of the guide 100 and a second guide portion 154 protruding from the rear of the guide. According to the illustrated embodiment, the first and second guide portions 152, 154 extend upward onto the upper portion 101 of the guide 100. The first guide portion 152 extends onto the first end 104 of the front member 102 and the second guide portion 154 extends upward onto the first end 124 of the rear member 122. Optionally, the guide portions 152, 154 may be located only on the lower portion 103 or only on the upper portion 101 of the guide. The second side member 160 includes a front edge 162 and a rear edge 164. An upper edge 161 of the second side member 160 extends between the front edge 162 and the rear edge 164. The upper edge 161 of the second side member 160 engages a lower portion 105 of a second end 106 of the front member 102 and a lower portion 125 of a second end 126 of the rear member 122. The second side member 160 includes a first guide portion 172 protruding from the front of the guide 100 and a second guide portion 174 protruding from the rear of the guide. According to the illustrated embodiment, the first and second guide portions 172, 174 extend upward onto the upper portion 101 of the guide 100. The first guide portion 172 extends onto the second end 106 of the front member 102 and the second guide portion 174 extends upward onto the second end 126 of the rear member 122. Optionally, the guide portions 172, 174 may be located only on the lower portion 103 or only on the upper portion 101 of the guide. If the guide 100 is integrally formed as a single plastic member, it is contemplated that the upper edges 141, 161 of the first and second side members 140, 160 are joined to the lower portions 105, 125 of the front and rear members 102, 122.

In operation, the switching element guide 100 positively retains the switching element 30 in a desired orientation within the switching device 10 and prevents undesired movement of the switching element. The switching element guide 100 is fit onto the switching element 30. The switching element 30 may be press fit between the first tab 110 and the second tab 130 extending upward from the front member 102 and from the rear member 122. The first and second tabs 110, 130 are made from a resilient material and are deflected outwards as the switching element 30 is fit between the two tabs. When the switching element 30 passes through the tabs 110, 130, the tabs return to their original position and help retain the switching element 30 within the guide 100. The switching element 30 rests on the first and second seats 108, 128 of the front and rear members 102, 122.

The switching element 30 may also include protrusions 36 configured to position the switching element guide 100 on the switching element and to help retain the positioning of the guide 100 with respect to the switching element 30. As best seen in FIG. 5, a pair of protrusions 36 extend laterally outward from the sides of the switching element. A first protrusion 36A and a second protrusion 36B form a pair of protrusions extending toward the first side 52 of the housing from the front side 35 of the switching element 30. A first protrusion 36A and a second protrusion 36B similarly form a pair of protrusions extending toward the second side 54 of the housing from the rear side 37 of the switching element 30. The first protrusion 36A and the second protrusion 36B are spaced apart a distance sufficient to receive the guide 100 between the two protrusions.

The switching element guide 100 and the switching element 30 are positioned over the spring 20 in the switching device 10. An opening 180 is defined between the first side member 140 and the second side member 160 in which the spring 20 fits. The first end 22 of the spring 20 fits in the opening 180 and rests in part against the switching element 30 and in part against the lower portions 105, 125 of the front and rear members 102, 122. The first and second side members 140, 160 restrict lateral motion of the guide 100 beyond the spring 20 seated in the opening 180. The guide 100, in turn, restricts lateral motion of the switching element 30 seated within the guide.

When inserted within the switching device 10, the guide portions 152, 154, 172, 174 engage the channels 55 on the housing 50 to further assist in retaining a desired orientation of the switching element 30. The front guide portions 152, 172 protruding from the front edges 142, 162 of the first and second side members 140, 160, respectively, engage channels 55 extending along an interior surface of the first side 52. Similarly, the rear guide portions 154, 174 protruding from the rear edges 144, 164 of the first and second side members 140, 160, respectively, engage channels 55 extending along an interior surface of the second side 54. As the switching element 30 and, in turn, the switching element guide 100 are driven reciprocally along the axis 12 between the plunger 14 and the spring 20, the guide portions 152, 154, 172, 174 slide within the channels 55 of the housing 50 are similarly driven in a direction parallel to the axis 12 along which the plunger travels. If, for example, the axis 12 is in a vertical direction and the plunger travels up-and-down, the guide portions 152, 154, 172, 174 similarly travel up-and-down within the channels 55. The guide portions prevent rotation of the switching element 30 either longitudinally or laterally. Preventing longitudinal rotation helps both contacts 38 on the switching element 30 make contact with and break apart from the corresponding contact within the switching device 10 in tandem. Preventing lateral rotation of the switching element 30 eliminates a failure mode of the switching device 10 discussed above. Specifically, if the switching element is subject to rapid switching or experiences a vibration or impulse force of sufficient magnitude such that the spring 20 and plunger 14 are no longer actively engaging both sides of the switching element 30, without the guide 100, the failure mode allowed the switching element 30 to rotate within the switching device 10 such that it was either perpendicular to its original orientation or it flipped over entirely and the contacts 38 on the switching element were facing away from the complementary contacts in the switching device 10. With the switching element guide 100 present on the switching element, the guide portions 152, 154, 172, 174 engage the sides 52, 54 of the housing 50 and prevent rotation of the switching element 30.

In addition to preventing rotation of the switching element 30, the guide portions 152, 154, 172, 174 assist in aligning the contacts 38 on the switching element 30 with the complementary contacts in the switching device. As the guide portions 152, 154, 172, 174 are engaged within the channels 55 on the sides 52, 54 of the housing, the switching element guide 100 resists longitudinal movement of the switching element 30. Additionally, because the front guide portions 152, 172 engage the first side 52 of the housing and the rear guide portions 154, 174 engage the second side 54 of the housing, the switching element guide prevents lateral movement of the switching element 30. The protrusions 36 extending from the switching element 30 on either side of the guide further prevent lateral movement of the switching element 30 with respect to the guide 100. The protrusions 36 are spaced apart from each other at a width equal to the width of the guide 100. Thus, the switching element 30 is retained longitudinally with respect to the switching element guide 100 by the protrusions 36 and the switching element guide 100 is retained longitudinally within the channel 64 by the guide portions 152, 154, 172, 174 engaging the channels 55 and by the opening 180 in the lower portion 103 receiving the spring 20.

By aligning the contacts 38 on the switching element with the complementary contacts in the switching device and by preventing longitudinal rotation of the switching element such that the contacts 38 make and break the complementary contacts in tandem, operation of the contacts is generally improved and the life of the contacts extended.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

We claim:

1. A guide for a switching element, comprising:

a front member configured to extend longitudinally along a front side of the switching element, the front member having:

a first seat configured to receive a lower surface of the switching element, and a first tab configured to retain the switching element within the guide;

a rear member configured to extend longitudinally along a rear side of the switching element, the rear member having:

a second seat configured to receive the lower surface of the switching element, and a second tab configured to retain the switching element within the guide;

a first side member having a front edge and a rear edge, the first side member extending between a first end of a lower portion of the front member and a first end of a lower portion of the rear member, the first side member having:

a first guide portion protruding outward from the front edge of the first side member, and a second guide portion protruding outward from the rear edge of the first side member; and a second side member having a front edge and a rear edge, the second side member extending between a second end of the lower portion of the front member and a second end of the lower portion of the rear member, the second side member having:

a third guide portion protruding outward from the front edge of the second side member, and a fourth guide portion protruding outward from the rear edge of the second side member, wherein an opening is defined between the first side member and the second side member, the opening is configured to receive a spring between the first and second side members, and the spring engages the lower surface of the switching element, the lower portion of the front member, and the lower portion of the rear member when it is inserted into the opening.

2. The guide of claim 1, wherein:

the switching element extends longitudinally within a channel of a switching device, the switching element includes a first pair of protrusions on the front side of the switching element, the switching element includes a second pair of protrusions on the rear side of the switching element, the first pair of protrusions is configured to receive the front member of the guide between the protrusions, and the second pair of protrusions is configured to receive the rear member of the guide between the protrusions.

3. The guide of claim 1, wherein:

the switching element is configured to move along an axis between a first position and a second position, the first guide portion and the second guide portion extend along the first side member in a direction parallel to the axis and protrude outward in a direction orthogonal to the axis, and the third guide portion and the fourth guide portion extend along the second side member in a direction parallel to the axis and protrude outward in a direction orthogonal to the axis.

4. The guide of claim 1, wherein:

the switching element is mounted in a housing;

the first guide portion and the second guide portion engage a first channel and a second channel, respectively;

the first channel and the second channel are defined along an interior of a first side of the housing;

the third guide portion and the fourth guide portion engage a third channel and a fourth channel, respectively; and the third channel and the fourth channel are defined in along an interior of a second side of the housing.

5. The guide of claim 1 wherein the first tab and the second tab are made of a resilient material, such that the first tab and the second tab are deflected outward as the switching element is inserted between the first tab and the second tab and the first tab and the second tab return to their original position when the switching element is located on the first seat and the second seat to retain the switching element within the guide.

6. The guide of claim 1 wherein the front member, rear member, first side member, and second side member are each made from a plastic material and integrally formed as a single mechanical element.

7. A switching device, comprising:

a plunger configured to move reciprocally along an axis between a first position and a second position;

a spring configured to be selectively compressed as the plunger is moved reciprocally along the axis;

a switching element positioned between the plunger and the spring, wherein:

the switching element has an upper surface, a lower surface, and side surfaces extending between the upper surface and the lower surface, the spring is seated, at least in part, against the switching element, and the switching element receives a force applied by the spring in a direction toward the plunger; and a guide for the switching element, the guide including:

an upper portion defining a seat configured for the lower surface of the switching element, at least one tab located on the upper portion, the at least one tab extending along one of the side surfaces and over at least a portion of the upper surface of the switching element and configured to retain the switching element within the guide, and a lower portion defining an opening through which an end of the spring is seated.

8. The switching device of claim 7 further comprising a housing including a first side and a second side, wherein:

the first side of the housing is located on a first side of the guide, the second side of the housing is located on a second side of the guide, the guide further includes at least one first guide portion protruding from the first side of the guide toward the first side of the housing, and the guide further includes at least one second guide portion protruding from the second side of the guide toward the second side of the housing.

9. The switching device of claim 8 wherein an interior of the first side of the housing includes at least one channel configured to receive the at least one first guide portion and an interior of the second side of the housing includes at least one channel configured to receive the at least one second guide portion.

10. The switching device of claim 7 wherein the switching element includes a first pair of protrusions on a first side of the switching element and a second pair of protrusions on a second side of the switching element, the first and second pair of protrusions configured to receive the guide between the protrusions.

11. The switching device of claim 7 wherein the guide further includes:

a front member on the upper portion of the guide, the front portion having:

a first seat configured to receive a lower surface of the switching element, and a first tab configured to retain the switching element within the guide; and a rear member on the upper portion of the guide, the rear member having:

a second seat configured to receive the lower surface of the switching element, and a second tab configured to retain the switching element within the guide, wherein the first seat and the second seat on the front member and rear member, respectively, define the seat for switching element, and wherein the first tab and the second tab on the front member and the second member, respectively, define the at least one tab located on the upper portion.

12. The switching device of claim 11 wherein the guide further includes:

a first side member on the lower portion, the first side member having a front edge and a rear edge, and the first side member extending between a first end of a lower portion of the front member and a first end of a lower portion of the rear member, and a second side member on the lower portion, the second side member having a front edge and a rear edge, and the second side member extending between a second end of the lower portion of the front member and a second end of the lower portion of the rear member, wherein the opening in which the end of the spring is seated is defined between the first side member and the second side member.

13. The switching device of claim 12 wherein:

the first side member includes:

a first guide portion protruding outward from the front edge of the first side member, and a second guide portion protruding outward from the rear edge of the first side member; and the second side member includes:

a third guide portion protruding outward from the front edge of the second side member, and a fourth guide portion protruding outward from the rear edge of the second side member.

14. A guide for a switching element, wherein the switching element has an upper surface, a lower surface, and side surfaces extending between the upper and the lower surface, the guide comprising:

an upper portion defining a seat for the lower surface of the switching element, at least one tab located on the upper portion, the at least one tab extending along one of the side surfaces and over at least a portion of the upper surface of the switching element and configured to retain the switching element within the guide, and a lower portion defining an opening in which an end of a spring is seated, the end of the spring being seated in part against the switching element and in part against the guide.

15. The guide of claim 14 wherein the switching element includes a first pair of protrusions on a first side of the switching element and a second pair of protrusions on a second side of the switching element, the first and second pair of protrusions configured to receive the guide between the protrusions.

16. The guide of claim 14 further comprising:

a front member on the upper portion of the guide, the front portion having:

a first seat configured to receive a lower surface of the switching element, and a first tab configured to retain the switching element within the guide; and a rear member on the upper portion of the guide, the rear member having:

a second seat configured to receive the lower surface of the switching element, and a second tab configured to retain the switching element within the guide, wherein the first seat and the second seat on the front member and rear member, respectively, define the seat for switching element, and wherein the first tab and the second tab on the front member and the second member, respectively, define the at least one tab located on the upper portion.

17. The guide of claim 16 further comprising:

a first side member on the lower portion, the first side member having a front edge and a rear edge, and the first side member extending between a first end of a lower portion of the front member and a first end of a lower portion of the rear member, and a second side member on the lower portion, the second side member having a front edge and a rear edge, and the second side member extending between a second end of the lower portion of the front member and a second end of the lower portion of the rear member, wherein the opening in which the end of the spring is seated is defined between the first side member and the second side member.

18. The guide of claim 17 wherein:

the first side member includes:

a first guide portion protruding outward from the front edge of the first side member, and a second guide portion protruding outward from the rear edge of the first side member; and the second side member includes:

a third guide portion protruding outward from the front edge of the second side member, and a fourth guide portion protruding outward from the rear edge of the second side member.

19. The guide of claim 14 wherein:

the switching element is configured to be mounted in a housing including a first side and a second side, the first side of the housing is located on a first side of the guide when the switching element is mounted in the housing, the second side of the housing is located on a second side of the guide when the switching element is mounted in the housing, the guide further comprises:

at least one first guide portion protruding from the first side of the guide, wherein the at least one first guide protrudes toward the first side of the housing when the switching element is mounted in the housing, and at least one second guide portion protruding from the second side of the guide, wherein the at least one second guide protrudes toward the second side of the housing when the switching element is mounted in the housing.

20. The guide of claim 19 wherein an interior of the first side of the housing includes at least one channel configured to receive the at least one first guide portion and an interior of the second side of the housing includes at least one channel configured to receive the at least one second guide portion.

* * * * *